US010347224B2

(12) United States Patent
Iwase

(10) Patent No.: US 10,347,224 B2
(45) Date of Patent: Jul. 9, 2019

(54) KEY OF KEYBOARD INSTRUMENT

(71) Applicant: KAWAI MUSICAL INSTRUMENTS MANUFACTURING CO., LTD., Shizuoka-ken (JP)

(72) Inventor: Masahiko Iwase, Shizuoka-ken (JP)

(73) Assignee: KAWAI MUSICAL INSTRUMENTS MANUFACTURING CO., LTD, Shizuoka-Ken (JP)

( * ) Notice: Subject to any disclaimer, the term of this patent is extended or adjusted under 35 U.S.C. 154(b) by 0 days.

(21) Appl. No.: 15/247,757

(22) Filed: Aug. 25, 2016

(65) Prior Publication Data

US 2017/0061938 A1 Mar. 2, 2017

(30) Foreign Application Priority Data

Aug. 28, 2015 (JP) ..... 2015-169459
Aug. 28, 2015 (JP) ..... 2015-169460

(51) Int. Cl.
*G10C 3/12* (2006.01)
*G10H 1/34* (2006.01)

(52) U.S. Cl.
CPC ..... *G10C 3/12* (2013.01); *G10H 1/346* (2013.01); *G10H 2220/265* (2013.01)

(58) Field of Classification Search
CPC ..... G10C 3/12; G10H 1/346; G10H 2220/265
USPC ..... 84/436
See application file for complete search history.

(56) References Cited

U.S. PATENT DOCUMENTS 2,620,539 A * 12/1952 Poupitch ..... F16B 5/10 29/446
7,999,162 B2 * 8/2011 Izutani ..... G10C 3/12 84/174
8,672,601 B2 * 3/2014 Nitsche ..... F16B 19/004 24/292
8,921,676 B2 * 12/2014 Iwase ..... G10H 1/346 84/433
2015/0170619 A1 6/2015 Iwase

FOREIGN PATENT DOCUMENTS

JP H10-7184 A 1/1998
JP 2015114597 6/2015

OTHER PUBLICATIONS

Japanese Notice of Reasons for Rejection dated Apr. 2, 2019 for Application No. 2015-169460.

* cited by examiner

*Primary Examiner* — Jianchun Qin
(74) *Attorney, Agent, or Firm* — Ferguson Case Orr Paterson

(57) ABSTRACT

A key in one aspect of the present disclosure comprises a key body, a hook, a weight, and a stopper. When the weight is accommodated in a hole of the key body, the weight is supported inside of the hole at least at the following two points: a point α where the stopper is caught on the hook; and a point γ where the weight abuts on a wall surface of the hole, when the weight is rotated about the point α.

9 Claims, 8 Drawing Sheets

KEY OF KEYBOARD INSTRUMENT

CROSS-REFERENCE TO RELATED APPLICATIONS

This application claims the benefit of Japanese Patent Application Nos. 2015-169459 and 2015-169460 filed Aug. 28, 2015 in the Japan Patent Office, the entire disclosures of which are incorporated herein by reference.

BACKGROUND

The present disclosure relates to a key of a keyboard instrument.

A plastic key of an electronic piano is formed into a shape having an open lower portion for the purpose of facilitating molding. On an inner side of the key, a plurality of ribs are provided in order to increase an overall strength of the key. Thus, the key has such an appearance that a plurality of holes are open downward.

An invention has been disclosed in which a weight is attached to one of a plurality of holes provided in a key, so as to adjust touch feeling of the key. The weight described, for example, in Japanese Unexamined Patent Application Publication No. 2015-114597 is entirely formed of an elastic material such as rubber. The weight has a main body formed into a rectangular parallelepiped shape, and a plurality of pleats provided on the main body.

The weight is cut in such a manner that its weight matches touch feeling of each key and is pushed into the hole of the key.

Upon pushing in, each of the pleats is bent in an opposite direction to a pushing direction. Therefore, the weight, when pushed into the hole of the key, is stretched inside the hole by a restoring force due to the bending of the pleats, and is retained so as not to escape from the hole.

SUMMARY

The weight, however, may be displaced in the hole or fall off from the hole in some cases, due to factors as below.

The factors may be, for example, weaker elastic force of the weight due to variations in material properties and/or temperature change, slippery of the weight in the hole by adhesion of grease or the like to the hole, and abnormality in the shape of the pleats due to molding defects of the weight.

In one aspect of the present disclosure, it is desirable to be able to provide a key with a weight that is hard to drop.

A key in one aspect of a keyboard instrument according to the present disclosure comprises a key body, a hook, a weight, and a stopper. The key body has a hole formed on a side opposite to a side of the key body to be touched by a player during performance. The hook extends from an edge of an opening of the hole and closes part of the opening. The hook has a notch formed at a distal end in an extending direction of the hook. The weight is formed of an elastically deformable material and is retained and accommodated in the hole by an elastic force. The stopper is provided in the weight, and is caught on the hook when the weight is accommodated in the hole.

The hook is sized to be able to hook the weight inside the hole (allow the weight to be supported inside the hole), when the weight is accommodated in the hole, at least at the following two points.

One of the two points is a point (point $\alpha$) where the stopper is caught on the hook. The other point is a point (point $\gamma$) where the weight abuts on a wall surface of the hole when the weight is rotated about the point $\alpha$.

The weight, because it is formed of an elastically deformable material, is stretched inside the hole to be retained in the key body when pushed into the hole provided in the key body. Furthermore, the weight is retained by being supported at least at the two points of the point (point $\alpha$) where the stopper is caught on the hook, and the point (point $\gamma$) where the weight comes into contact with the wall surface of the hole when the weight seeks to rotate around the hook.

The weight is provided with the stopper. The weight is elastically deformed when inserted into the hole, and climbs over the hook while allowing part of the stopper to escape into a notch. Therefore, the weight is pushed smoothly into the hole without being caught on the hook, and is retained by the stopper.

The key of the keyboard instrument of the present disclosure is able to suppress falling off of the weight from the key body, because double retaining measures are provided. Although the key of the keyboard instrument of the present disclosure is provided with the stopper, the weight can be pushed smoothly into the hole due to elastic deformation of the weight and escape into the notch.

Note that the edge from which the hook extends may be not only the edge of the opening but the vicinity of the edge.

In the key of the keyboard instrument, the stopper may be formed to have a triangular cross section.

The stopper having a triangular cross section is more easily elastically deformed and more easily passes the notch, as compared with a case where a cross-sectional shape of the stopper is other than a triangle, for example, a rectangle.

The weight provided in the key of the keyboard instrument may comprise a weight body, and a plurality of pleats. The plurality of pleats may be provided on a surface along a plane perpendicular to a rotation axis at the time when the weight body seeks to rotate inside the hole, and may be arranged side by side along a direction to push the weight into the hole.

When the weight is inserted into the hole, each of the pleats is bent in an opposite direction to the pushing direction, in addition to elastic deformation of the weight body. Thus, an entire width of the weight becomes small.

Therefore, the key of the keyboard instrument of the present disclosure, as compared with the case where only the weight body is elastically deformed, the weight can be pushed smoothly into the hole.

After the weight is pushed into the hole, the respective pleats are spread and stretched. Thus, the weight is securely fixed inside the hole.

In the weight of the key of the keyboard instrument, an opposing surface provided with the stopper may be formed to have a greater width than the stopper. The notch of the hook may be formed to have a smaller width than the stopper. The weight may be sized, when inserted into the hole, to fit in the opening as the stopper abuts on the hook from inside of the hole.

When the weight is inserted into the hole, the weight fits into the opening and a distal end of the hook abuts on the weight. Thus, the stopper is caught firmly on the hook.

According to the key of the keyboard instrument of the present disclosure, the weight is even less likely to escape from the hole.

A key of the keyboard instrument of another aspect of the present disclosure comprises a key body, a weight, and a fall-off suppressing unit. The key body has a hole formed on a side opposite to a side of the key body to be touched by a player during performance. The weight is formed of an elastically deformable material. The weight is pushed into the hole to be retained therein. The fall-off suppressing unit protrudes into the hole. The fall-off suppressing unit has a height that allows the elastically deformed weight to climb over the fall-off suppressing unit when the weight is pushed into the hole, and that can suppress escape from the hole of the weight that has climbed over the fall-off suppressing unit.

The weight, when pushed into the hole of the key body, is not only stretched inside the hole to be retained in the key body but also retained by the fall-off suppressing unit.

Since the fall-off suppressing unit has such a height that the elastically deformed weight can climb over the fall-off suppressing unit, the weight is pushed smoothly into the hole without being obstructed by the fall-off suppressing unit.

In the key of the keyboard instrument of the present disclosure, since double retaining measures are provided, falling off of the weight from key body can be suppressed. In the key of the keyboard instrument of the present disclosure, the weight can be pushed smoothly into the hole.

The key of the keyboard instrument may comprise a protruding displacement suppressing unit formed in the hole. The displacement suppressing unit may be provided behind the fall-off suppressing unit when viewed from the opening of the hole, and have a lower height than the fall-off suppressing unit.

Even if a gap is produced, because the weight is small in thickness, between an upper end of the fall-off suppressing unit and a lower end of the weight of the key when the weight is pushed into the hole, the displacement suppressing unit bites the weight, and thus a top and bottom backlash of the weight can be suppressed.

The key of the keyboard instrument can suppress falling off of the weight from the key body. The key of the keyboard instrument can suppress a backlash of the weight.

The weight may comprise a weight body, and a plurality of pleats provided on a surface of the weight body that is opposed to the fall-off suppressing unit when the weight is pushed into the hole. The plurality of pleats may be aligned along a direction to push the weight into the hole.

When the weight climbs over the fall-off suppressing unit, the weight is elastically deformed and further each of the pleats is bent in a direction opposite to the pushing direction. Thus, reduction of an overall width of the weight is achieved.

If the pleats are bent, the weight can be pushed smoothly into the hole without being obstructed by the fall-off suppressing unit, as compared with a case where only the weight body is elastically deformed.

If the key body is provided with the displacement suppressing unit inside the hole, the displacement suppressing unit is fitted in between the pleat that climbs over the fall-off suppressing unit to be spread and the pleat that does not climb over the fall-off suppressing unit when the weight is inserted to the key. Since the weight is securely fixed to the key due to this fit-in, a top and bottom backlash of the weight can be suppressed.

The key of the keyboard instrument, if provided with the displacement suppressing unit, can further suppress falling off of the weight from the key body. The key of the keyboard instrument, if provided with the displacement suppressing unit, can suppress a backlash of the weight.

BRIEF DESCRIPTION OF THE DRAWINGS

Embodiments of the present disclosure will be illustrated with reference to the accompanying drawings, in which.

DETAILED DESCRIPTION OF THE PREFERRED EMBODIMENTS

First Embodiment

A key 1 of an electronic piano of the present embodiment comprises a key body 3, and a weight 5.

Figure 1:
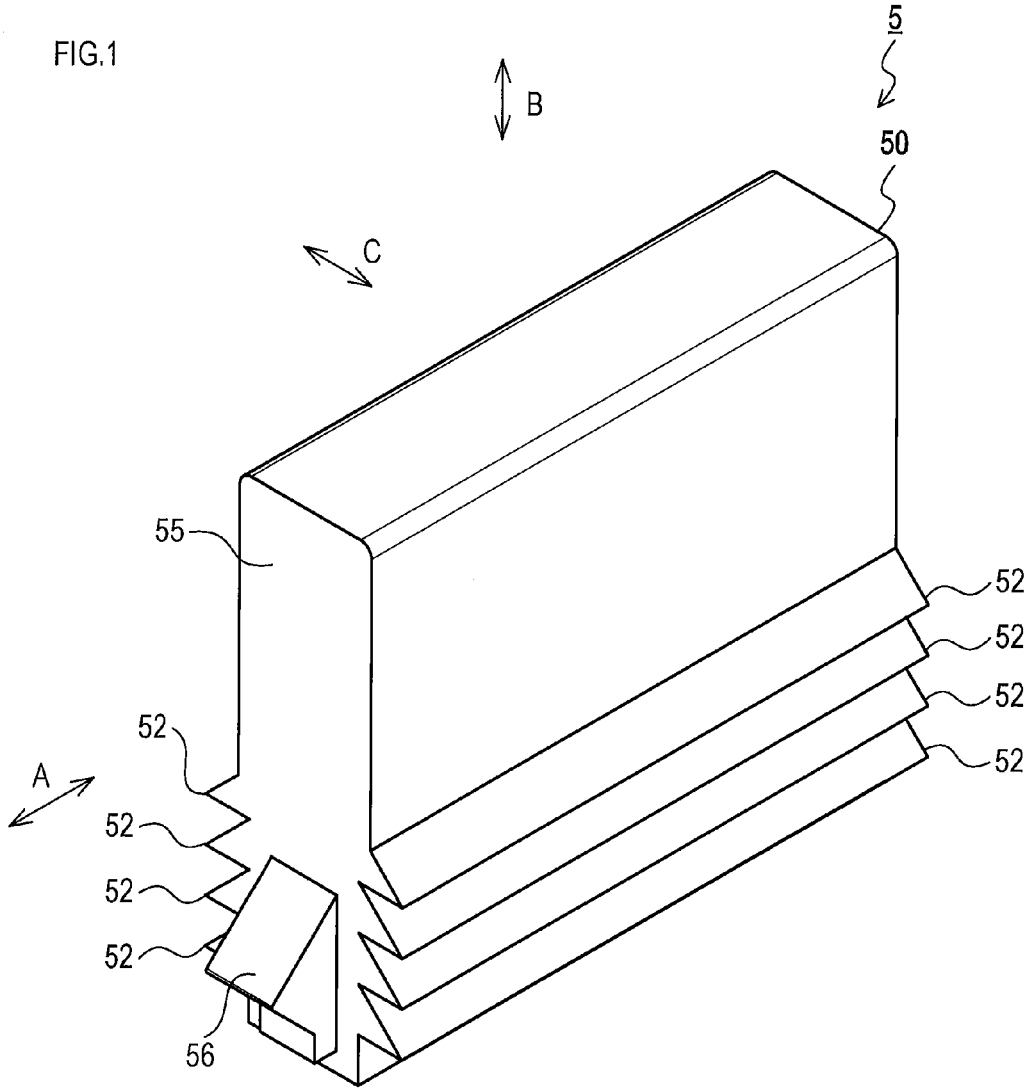
FIG. 1 is a perspective view of a weight of a first embodiment.

Description on the weight 5 will be given with reference to FIG. 1.

The weight 5 is made of a material containing a rubber mixed with iron powder. The weight 5 has a weight body 50 and a plurality of pleats 52.

The weight body 50 is formed into a rectangular parallelepiped in which a length in a front and rear direction (arrow A) (longitudinal length) is the longest, a length in an up and down direction (arrow B) (length in a height direction) is the second longest, and a length in a left and right direction (arrow C) (lateral length) is the shortest. For example, the front and rear direction is a direction along which a player sees the electronic piano in front, the left and right direction is a direction along an arrangement direction of a plurality of the keys 1, and the up and down direction is a vertical direction.

The plurality of pleats 52 are provided on two side surfaces perpendicular to the right and left direction (arrow C), among respective side surfaces along a pushing direction (direction of the arrow B in FIG. 1) of the weight 5 into a hole 30 to be described later (see FIGS. 2A and 2B), and are arranged side by side along the pushing direction B. The plurality of pleats 52 are provided only in a portion of ⅔ on a lower side of each of the two side surfaces of the weight 5 provided with the plurality of pleats 52.

It should be noted that the weight 5, as will be described later, seeks to rotate inside the hole 30 when pushed into the hole 30.

Specifically, the weight 5 seeks to rotate around a rotation axis perpendicular to a plane provided with the pleats 52.

That is, it can say that the plurality of pleats 52 are provided on a plane perpendicular to a rotation axis at the time when the weight body 50 seeks to rotate inside the hole 30, and are provided side by side along the direction to push the weight 5 into the hole 30.

Each pleat 52 is formed into a linear shape along the front and rear direction A. Each pleat 52 has a cross-section formed into a right triangle, so that the entire cross-sectional shape (cross-sectional shape of a plane orthogonal to a longitudinal direction (direction of the arrow A in FIG. 1)) of the pleats 52 has a saw blade shape.

A double-sided tape is also attached to an upper surface of the weight body 50.

In the weight body 50, a stopper 56 is provided on a side surface at a front (opposing surface 55) out of the two side surfaces perpendicular to the front and rear direction (arrow A).

The stopper 56 is a protrusion having a cross section formed into a triangle, when viewed in a cross section in a direction orthogonal to the right and left direction (arrow C).

The opposing surface 55 is formed to have a greater width along the right and left direction (arrow C) than the stopper 56.

Figure 2A:
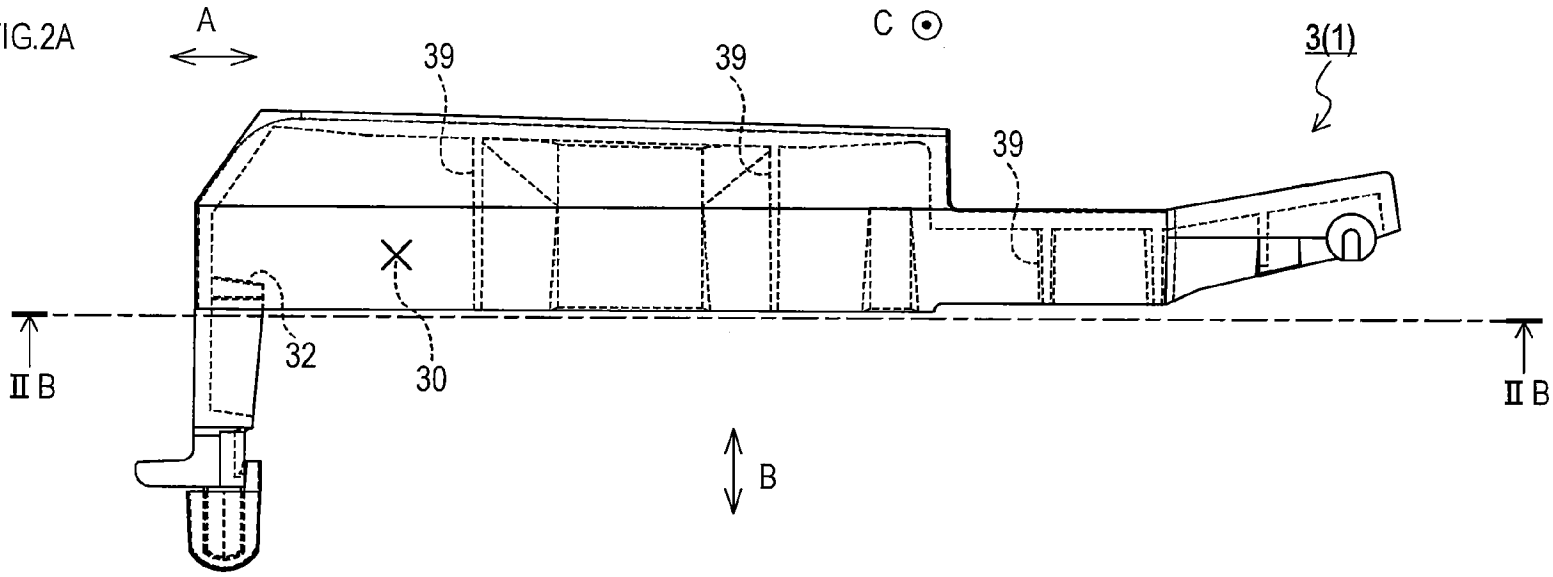
FIG. 2A is a front view of a key body showing its internal structure in a transparent view, in the first embodiment.
Figure 2B:
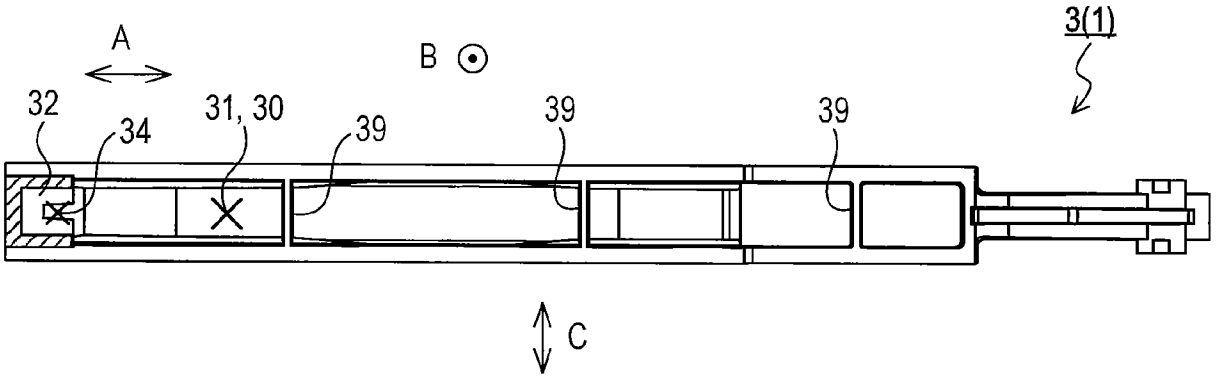
FIG. 2B is a cross-sectional view taken by a line IIB-IIB of FIG. 2A.
Figure 3:
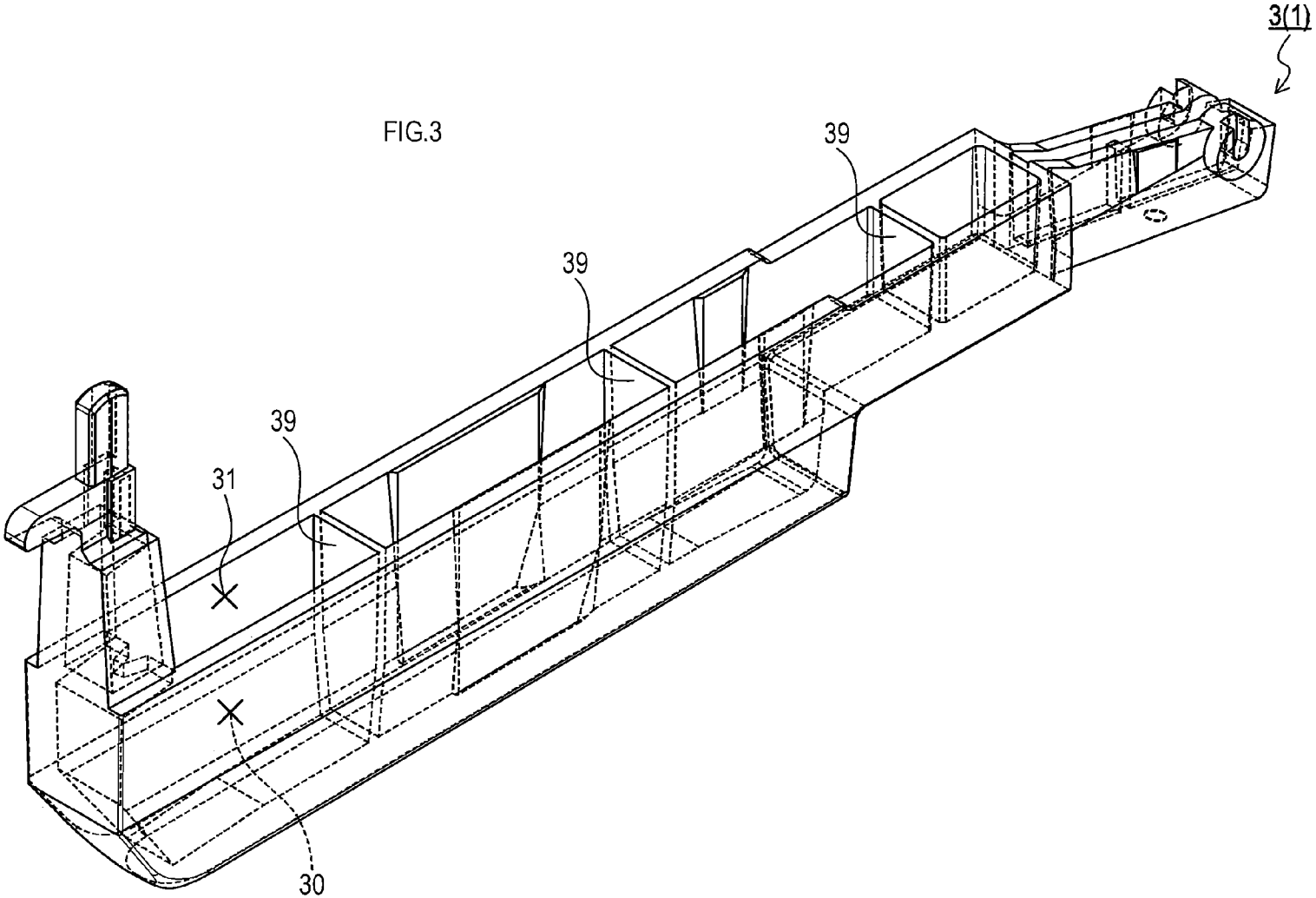
FIG. 3 is a transparent perspective view of the key body from a back side, in the first embodiment.

Description on the key body 3 will be given with reference to FIGS. 2A, 2B, and 3.

The key body 3 has a plurality of holes separated by a plurality of ribs 39, including the above described hole 30 for attachment of the weight 5. Each hole is open at a back side, when it is assumed that a side of the key 1 to be touched by the player during the performance is a surface side. A center of gravity of the key body 3 is located at a substantially central portion in a longitudinal direction (front and rear direction: arrow A) thereof. The hole 30 is provided at a position closer to the player side than the center of gravity of the key body 3.

The hole 30 of the key body 3 is provided with a hook 32. The hook 32 extends from an edge on a front side (player side) of an opening 31 (see FIG. 3) of the hole 30 to a rear side and closes part of the opening 31. Further, the hook 32 has a notch 34 at a distal end (distal end on the rear side) thereof in an extending direction (front and rear direction: arrow A).

Figure 4:
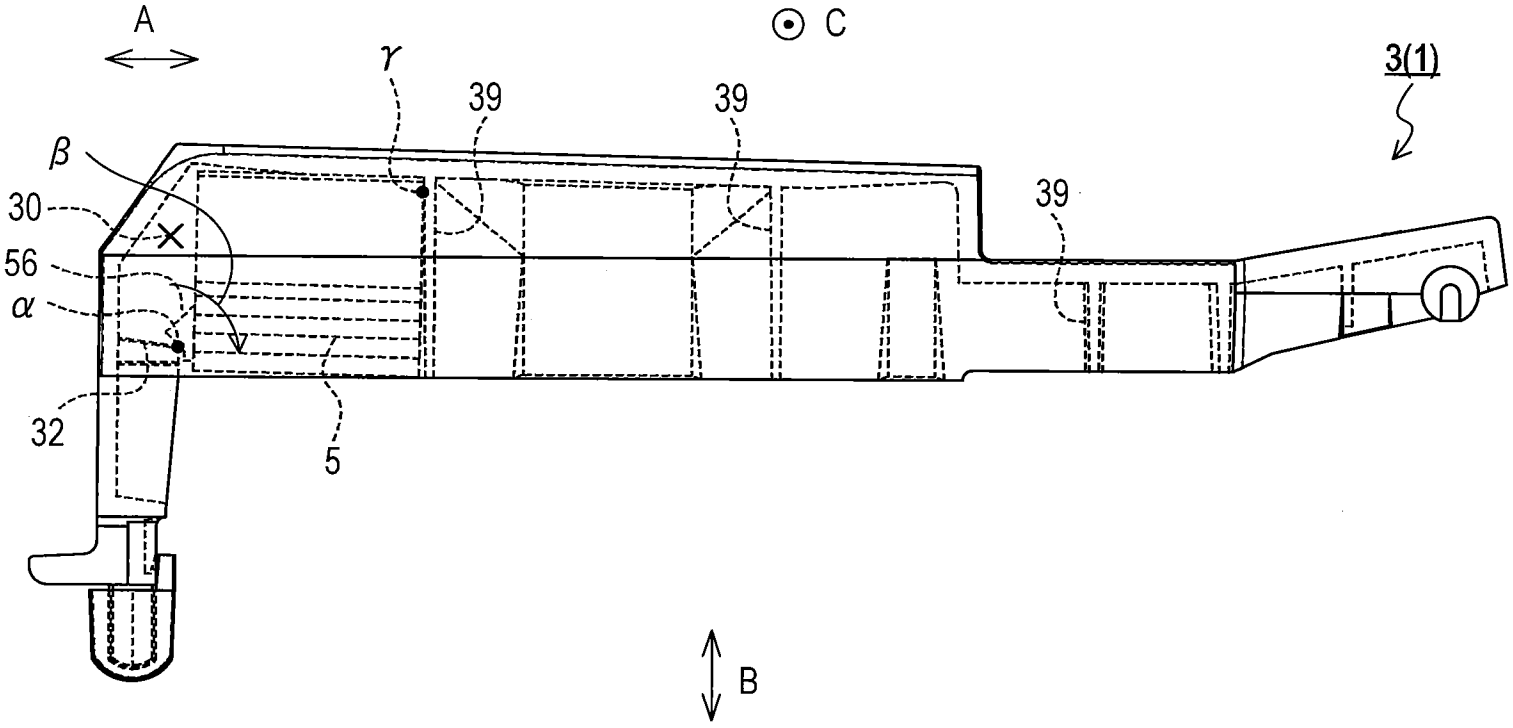
FIG. 4 is a front view of a key showing its internal structure in a transparent view, in the first embodiment.

The weight 5, when it is accommodated in the hole 30 (see FIG. 4), is caught at two points. More specifically, the weight 5 is caught at least at a point α where the stopper 56 is hooked by the hook 32, and a point γ where the weight body 50 abuts on a wall surface of the hole 30. The point γ, in particular, is a contact point between the farthest corner from the point α in the weight 5 and the wall of the hole 30 of the key body 50 when the weight 5 is rotated about the point α where the stopper 56 is caught at the hook 32 (direction of the arrow β in FIG. 4).

The weight body 50 is sized to be able to pass the opening 31 narrowed by presence of the hook 32 when inserted into the hole 30.

The notch 34 provided in the hook 32 has a smaller width than the stopper 56.

Now, attachment of the weight 5 to the key body 3 described above will be described.

Upon attaching the weight 5 to the key body 3, firstly, the weight 5 is cut to an appropriate size in such a manner that a static load at a position of 23 mm from a front end of the key body 3 is 45 g to 80 g, depending on pitch of sound.

Then, the weight 5 is pushed into the hole 30 of the key body 3. At this time, the stopper 56 hits the hook 32, but the weight body 50, and also the stopper 56, are elastically deformed, so that the entire stopper 56 climbs over the hook 32. At this time, part of the stopper 56 passes the notch 34.

Thereafter, when the weight 5 is accommodated in the hole 30, the stopper 56 is caught on the hook 32 and is retained.

Further, the weight 5, when accommodated in the hole 30, is retained therein since the pleats 52 are stretched inside the hole 30.

Further, the weight 5, when accommodated in the hole 30, is supported and retained at least by the following two points: the contact point α between the stopper 56 and the hook 32; and the contact point γ where the weight 5 comes in contact with the wall surface of the hole 30 when the weight 5 is rotated around the hook 32.

As described above, the key 1 of the keyboard instrument in the first embodiment, in addition to the stretch of the respective pleats 52, multiple retaining measures are provided. Thus, falling off of the weight 5 can be suppressed. Further, in the key 1 of the keyboard instrument in the first embodiment, the weight 5 can be pushed smoothly into the hole 30.

(1) The weight 5 described in the first embodiment is merely an example, and the present disclosure is not limited thereto.

(2) In the first embodiment, rubber is exemplified as the material forming the weight 5. The material is not limited to rubber, and may be soft resin, such as, for example, a thermoplastic elastomer. Any material may be used as long as the material is elastic. Further, in the first embodiment, metal powder is mixed into the rubber. Material other than metal powder may be mixed into the rubber, or no material may be mixed into the rubber.

(3) In the first embodiment, the weight 5 is configured such that the static load of the key body 3, when the weight 5 is attached to the key body 3, is 45 to 80 g. The static load may be 50 to 70 g, more particularly, 53 to 57 g.

(4) In the first embodiment, an example of the keyboard instrument is an electronic piano, but the present disclosure is not limited thereto. For example, the keyboard instrument may be an electronic organ, synthesizer or the like.

(5) The weight 5 described in the first embodiment is produced by extrusion. The weight 5 may be cut to a suitable size during extrusion, or may be cut to a suitable size just prior to attachment to the key body 3. Further, the weight 5 may be molded to such a size that there is no need to be cut from the beginning.

(6) In the first embodiment, the weight 5 is provided with a double-sided tape, but there may be no double-sided tape.

Second Embodiment

A second embodiment of the present disclosure as an example will be described below with reference to FIGS. 5 to 8B.

A key 101 of an electronic piano of the present embodiment comprises a key body 103, and a weight 105.

Figure 5:
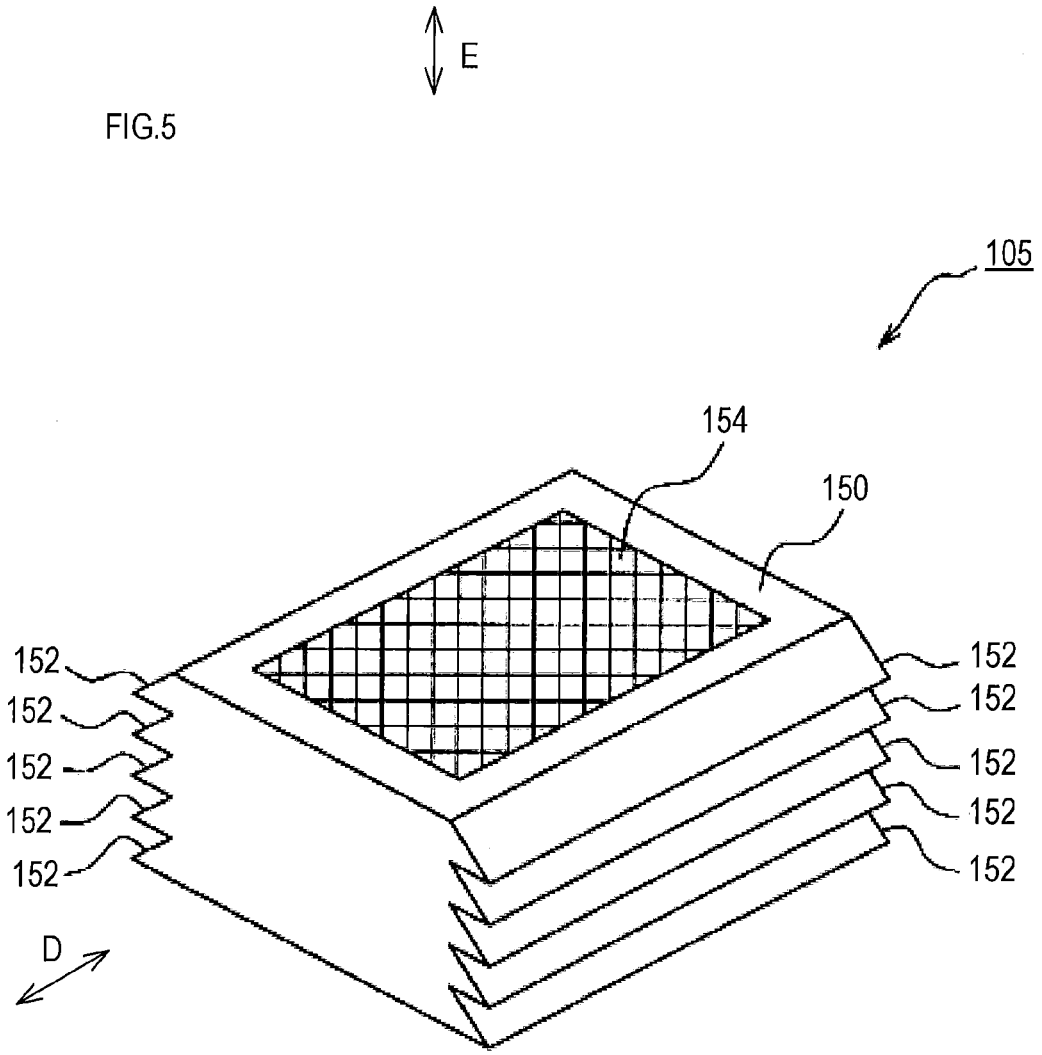
FIG. 5 is a perspective view of a weight of a second embodiment.

Description on the weight 105 will be given with reference to FIG. 5.

The weight 105 is made of a material comprising a rubber mixed with iron powder, and has a weight body 150 and a plurality of pleats 152.

The weight body 150 is formed into a rectangular parallelepiped.

The plurality of pleats 152 are provided on a pair of side surfaces located opposite to each other among a plurality of side surfaces (planes that make up a thickness of the weight body 150) along a direction (direction of an arrow E in FIG. 5) to push the weight 105 into a hole 130 (see FIGS. 6A, 6B) to be described below, and are arranged side by side along the pushing direction E.

Each pleat 152 is formed in a linear shape along a direction perpendicular to the pushing direction E. Each pleat 152 has a cross-section formed into a right triangle, so that the entire cross-sectional shape (cross-sectional shape of a plane perpendicular to a longitudinal direction of each pleat 152 (direction of an arrow D in FIG. 5)) has a saw blade shape.

Further, a double-sided tape 154 is attached to an upper surface of the weight body 150.

Figure 6A:
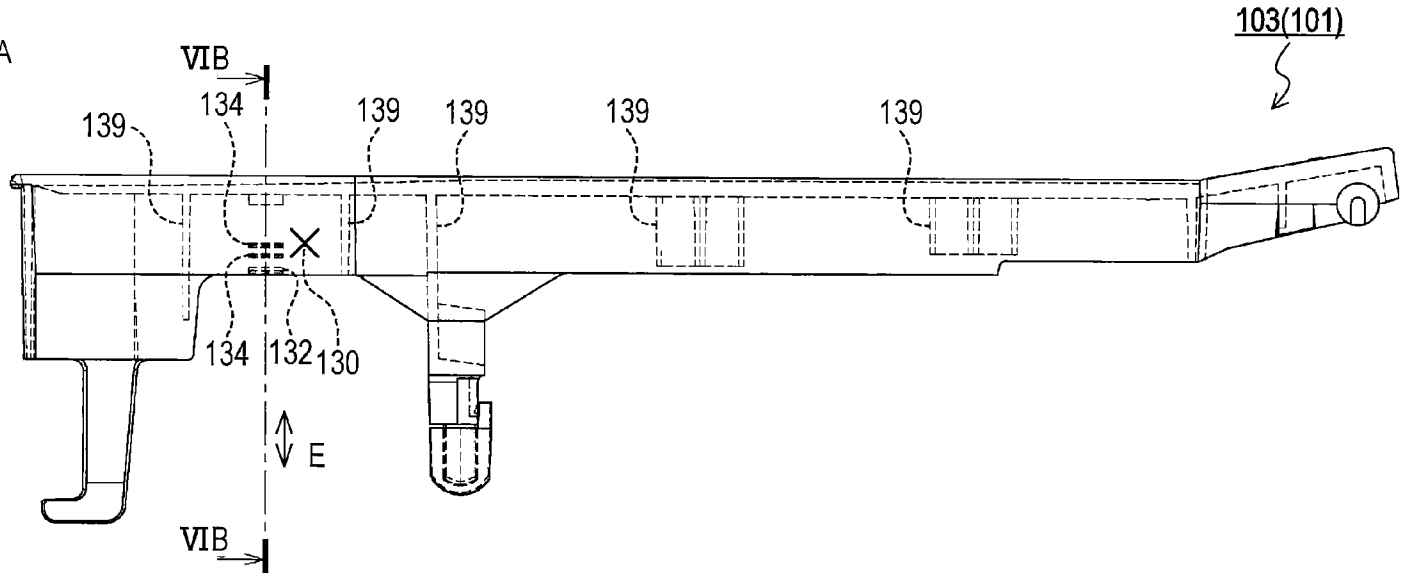
FIG. 6A is a front view of a key body showing its internal structure in a transparent view, in the second embodiment.
Figure 6B:
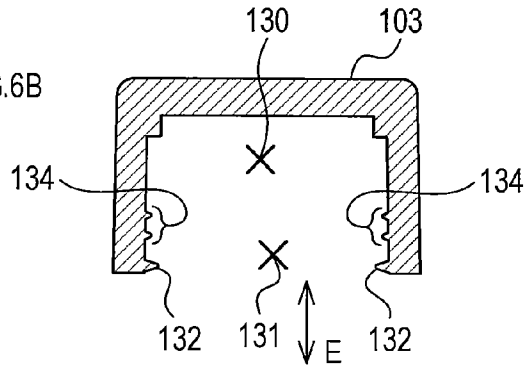
FIG. 6B is a cross-sectional view taken by a line VIB-VIB of FIG. 6A.
Figure 7:
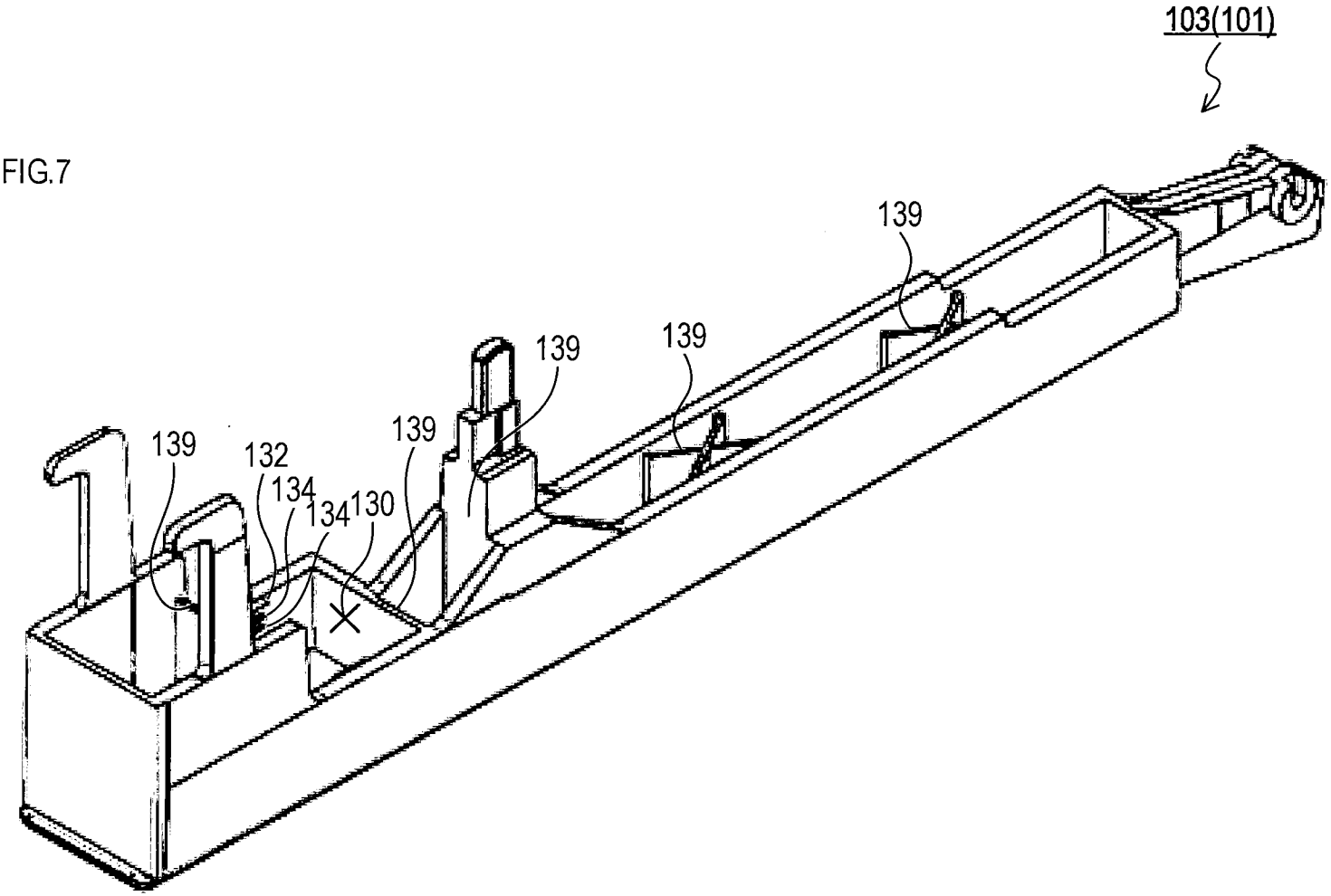
FIG. 7 is a rear perspective view of the key body, in the second embodiment.
Figure 8A:
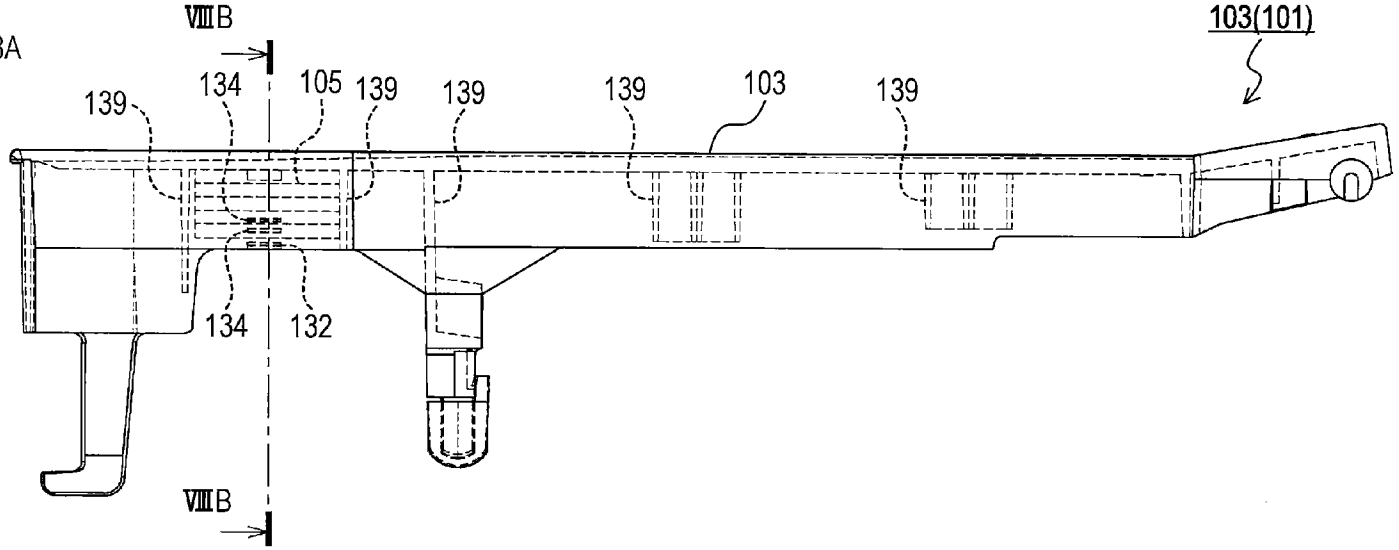
FIG. 8A is a front view of a key showing its internal structure in a transparent view, in the second embodiment.
Figure 8B:
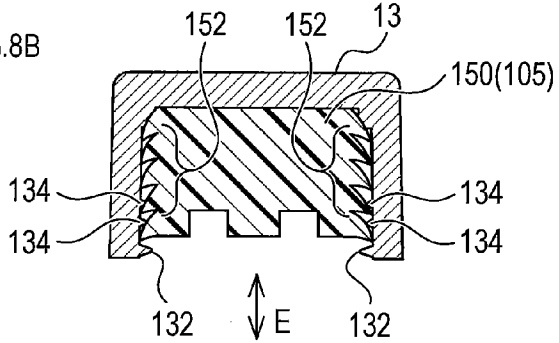
FIG. 8B is a cross-sectional view taken by a line VIIIB-VIIIB of FIG. 8A, in the second embodiment.

Description on the key body 103 will be given with reference to FIGS. 6A, 6B and 7.

The key body 103 has a plurality of holes separated by a plurality of ribs 39, including the above described hole 130 for attachment of the weight 105. Each hole is open at a back side, when it is assumed that a side of the key body 103 where a player touches the key 1 during performance is a surface side. The center of gravity of the key body 103 is located at a substantially central portion in a longitudinal direction of the key body 103. The hole 130 is provided at a position closer to the player side in the key body 103 than the center of gravity of the key body 103.

A plurality of inner wall surfaces of the key body 103 that form the hole 130 are orthogonal to an arrangement direction of a plurality of the keys 101. On each of the wall surfaces, fall-off suppressing units 132 and a pair of displacement suppressing units 134 that protrude towards an inside of the hole 130 are formed. Each of the fall-off suppressing units 132 and the displacement suppressing units 134 is formed into an elongated shape along a longitudinal direction of the key body 103. Further, the fall-off suppressing units 132 and the pair of displacement suppressing units 134 are arranged side by side in the pushing direction (direction of the arrow E in FIGS. 6A and 6B, and direction to push the weight 105 from the opening 31 of the hole 130).

The fall-off suppressing units 132 are protrusions provided in the vicinity of the opening 131 of the hole 130. The fall-off suppressing units 132 are climbed over by the elastically deformed weight 105 when the weight 105 is pushed into the hole 130. Also, the fall-off suppressing units 132 are formed such that a distance between distal ends of the respective fall-off suppressing units 132 becomes narrower than a width of the weight body 150. A height of each of the fall-off suppressing units 132 is adjusted in such a manner that the distance between the distal ends of the respective fall-off suppressing units 132 provided on the respective wall surfaces forming the hole 130 is a distance that the elastically deformed weight body 150 can pass, in consideration of deformation upon pushing of the wall surfaces provided with the fall-off suppressing units 132, the pleats 152 and the like.

Each of the displacement suppressing units 134 is formed to have a height lower than the fall-off suppressing units 132.

Attachment of the weight 105 to the key body 103 described above will be described.

Upon attaching the weight 105 to the key body 103, the weight 105 is cut to a suitable size so that a static load at a position of 23 mm from the front end of the key body 103 is 45 g to 80 g, depending on pitch of sound.

Then, the weight 105 is pushed into the hole 130 of the key body 103. At this time, although the weight 105 abuts on the respective fall-off suppressing units 132, the weight 105 is elastically deformed and the plurality of pleats 152 are bent in a direction opposite to the pushing direction E. Thus, the weight 105 climbs over the respective fall-off suppressing units 132.

Each of the fall-off suppressing units 132 is formed to have a height that can suppress escape of the weight 105 from the hole 130. Therefore, the weight 105, when accommodated in the hole 130, is retained by each of the fall-off suppressing units 132.

Further, when the weight 105 is accommodated in the hole 130, the plurality of pleats 152 that are closed when climbing over the fall-off suppressing units 132 are spread and stretched inside the hole 130 to retain the weight 105. Further, the plurality of stretched pleats 152 are caught on the respective fall-off suppressing units 132 to retain the weight 105.

Further, when the weight 105 is accommodated in the hole 130, and the plurality of pleats 152 are spread in the hole 130, the displacement suppressing units 134 fit in between the plurality of pleats 152. Thus, a backlash in the up and down direction is suppressed.

Further, the weight 105, when accommodated in the hole 130, is retained since the double-sided tape 154 adheres to the inside of the hole 130.

As described above, because multiple retaining measures are provided to the key 101 of the keyboard instrument of the second embodiment, falling off of the weight 105 can be suppressed. A backlash in the up and down direction of the weight 105 inside the key 101 is suppressed. Moreover, in the key 101, the weight 105 can be pushed smoothly into the hole 130.

(1) The weight 105 described in the second embodiment is merely an example, and the present disclosure is not limited thereto.

(2) In the second embodiment, rubber is exemplified as the material forming the weight 105. The material is not limited to rubber, and may be soft resin, such as, for example, a thermoplastic elastomer. Any material may be used as long as the material is elastic. Further, in the second embodiment, metal powder is mixed into the rubber. Material other than metal powder may be mixed into the rubber, or no material may be mixed into the rubber.

(3) In the second embodiment, the plurality of pleats 152 are provided on the side surface along the front and rear direction of the arrow D (see FIG. 5), among the surrounding side surfaces parallel to the direction E to push the weight body 150 into the hole 130. The plurality of pleats 152 may be provided on the side surface perpendicular to the arrow D.

(4) In the second embodiment, the weight body 150 is a rectangular parallelepiped, but this is not limited thereto. For example, the weight body 150 may be formed into a cylindrical shape. If the weight body 150 is formed into a cylindrical shape, the plurality of pleats 152 may be provided in some or all of the side surfaces around a central axis of the weight body 150. Further, the pleats 152 may be provided at two or three locations equally spaced around the central axis of the weight body 150.

(5) In the second embodiment, the weight 105 is configured such that the static load of the key body 103, when the weight 105 is attached to the key body 103, is 45 to 80 g. The static load may be 50 g to 70 g, more particularly 53 to 57 g.

(6) In the second embodiment, an example of the keyboard instrument is an electronic piano, but this is not limited thereto. For example, the keyboard instrument may be an electronic organ, synthesizer or the like.

(7) The weight 105 described in the second embodiment may be produced by extrusion, may be cut to a suitable size during extrusion, or may be cut to a suitable size just prior to attachment to the key body 103. Alternatively, the weight 105 may be molded to such a size that there is no need to be cut from the beginning.

(8) In the second embodiment, the weight 105 is provided with the double-sided tape 154, but there may be no double-sided tape 154.

What is claimed is:

1. A key comprising:

a key body having a hole formed at a lower side opposite to an upper side of the key body to be touched by a player during performance;

a hook extending from an edge of an opening of the hole and closing part of the opening, the hook having a notch at a distal end in an extending direction of the hook; and a weight formed of an elastically deformable material, the weight being retained and accommodated in the hole by an elastic force, wherein the weight includes a first side surface and a second side surface facing opposite to each other, and a stopper situated on the first side surface, wherein the notch of the hook is formed to have a smaller width than the stopper, and wherein the stopper is formed to have a triangular cross section, the stopper includes a first slanting surface slanting downwardly from the first side surface, and a second slanting surface slanting upwardly from the first side surface, the weight is supported inside the hole at least at a point $\alpha$ where the stopper is caught on the hook, and a point $\gamma$ where the weight abuts on a wall surface of the hole when the weight is rotated about the point $\alpha$, when the weight is accommodated in the hole, the point $\alpha$ is located on the second slanting surface, and the point $\gamma$ is located on the second side surface.

2. The key according to claim 1, wherein the weight comprises:

a weight body; and a plurality of pleats provided on a surface along a plane perpendicular to a rotation axis at the time when the weight body seeks to rotate inside the hole, the plurality of pleats being provided side by side along a direction to push the weight into the hole.

3. The key according to claim 2, wherein the plurality of pleats protrudes obliquely downwardly from the surface of the weight.

4. The key according to claim 2, wherein the plurality of pleats is situated within a bottom two-fifth area of the surface of the weight on which the plurality of pleats are provided.

5. The key according to claim 2, wherein the stopper is situated at a position where the stopper horizontally and at least partially overlaps the plurality of pleats.

6. The key according to claim 1, wherein the first side surface of the weight provided with the stopper has a greater width than the stopper, and the weight, when inserted into the hole, fits in the opening as the stopper abuts on the hook from inside of the hole.

7. The key according to claim 1, wherein the stopper is caught by portions of the hook on both sides of the notch when the weight is accommodated in the hole.

8. The key according to claim 1, wherein the first slanting surface and the second slanting surface meet substantially at a right angle.

9. A key comprising:

a key body having a hole formed at a lower side opposite to an upper side of the key body to be touched by a player during performance;

a hook extending from an edge of an opening of the hole and closing part of the opening; and a weight formed of an elastically deformable material, the weight being retained and accommodated in the hole by an elastic force, wherein the weight includes a first side surface and a second side surface facing opposite to each other, and a stopper situated on the first side surface, and wherein the stopper is formed to have a triangular cross section, the stopper includes a first slanting surface slanting downwardly from the first side surface, and a second slanting surface slanting upwardly from the first side surface, the weight is supported inside the hole at least at a point $\alpha$ where the stopper is caught on the hook, and a point $\gamma$ where the weight abuts on a wall surface of the hole when the weight is rotated about the point $\alpha$, when the weight is accommodated in the hole, the point $\alpha$ is located on the second slanting surface, and the point $\gamma$ is located on the second side surface.

* * * * *